US006379581B1

(12) United States Patent
Kamakura et al.

(10) Patent No.: US 6,379,581 B1
(45) Date of Patent: Apr. 30, 2002

(54) LUBRICATED REFRIGERANT COMPOSITION CONTAINING FLUOROCARBON-TYPE REFRIGERANT, SYNTHETIC OIL AND MOLYBDENUMOXYSULFIDE DERIVATIVES

(75) Inventors: Tamiji Kamakura; Noriyoshi Tanaka; Kimiyoshi Namiwa; Yukio Tatsumi; Masato Namiki, all of Tokyo (JP)

(73) Assignee: Asahi Denka Kogyo, K.K., Tokyo (JP)

( * ) Notice: Subject to any disclaimer, the term of this patent is extended or adjusted under 35 U.S.C. 154(b) by 0 days.

(21) Appl. No.: 08/395,780

(22) Filed: Feb. 28, 1995

Related U.S. Application Data

(63) Continuation of application No. 07/924,860, filed on Aug. 4, 1992, now abandoned.

(30) Foreign Application Priority Data

Aug. 5, 1991 (JP) ..... 3-195362

(51) Int. Cl.[7] ..... C10M 171/00; C10M 135/18; C10M 137/10; C10M 141/10

(52) U.S. Cl. ..... 252/68; 508/363; 508/364; 508/365; 508/370; 508/379

(58) Field of Search ..... 252/32.7 E, 46.6, 252/42.7, 46.7, 68, 565, 52 R; 508/363, 364, 365, 370, 379

(56) References Cited

U.S. PATENT DOCUMENTS

| | | | | |
|---|---|---|---|---|
| 3,402,188 A | | 9/1968 | Wiese | |
| 3,446,735 A | | 5/1969 | Wiese | |
| 3,840,463 A | | 10/1974 | Froeschmann et al. | |
| 3,925,213 A | | 12/1975 | Froeschmann et al. | |
| 4,208,292 A | | 6/1980 | Bridger | |
| 4,259,254 A | * | 3/1981 | Briger | 556/61 |
| 4,290,902 A | | 9/1981 | Levine et al. | |
| 4,755,316 A | | 7/1988 | Magid et al. | 252/68 |
| 4,832,867 A | | 5/1989 | Seiki | |
| 4,978,464 A | * | 12/1990 | Coyle et al. | 508/363 |
| 4,995,996 A | * | 2/1991 | Coyle et al. | 508/445 |
| 5,262,076 A | * | 11/1993 | Ishida et al. | 252/68 |
| 5,356,547 A | * | 10/1994 | Arai et al. | 508/364 |
| 5,445,749 A | * | 8/1995 | Hong | 252/68 |
| 5,922,239 A | * | 7/1999 | Nakagawa et al. | 252/68 |

FOREIGN PATENT DOCUMENTS

| | | |
|---|---|---|
| EP | 316610 | 5/1989 |
| EP | 397037 | 11/1990 |
| EP | 452816 | 10/1991 |
| EP | 527024 A1 * | 2/1993 |
| GB | 1295442 | 11/1972 |
| GB | 2064541 | 6/1981 |
| JP | 57-24797 | 5/1975 |
| JP | 57-24798 | 5/1975 |
| JP | 57-24799 | 5/1975 |
| JP | 55-40593 | 7/1976 |
| JP | 53-31646 | 2/1977 |
| JP | 56-12638 | 2/1977 |
| JP | 58-50233 | 7/1977 |
| JP | 57-8294 | 1/1982 |
| JP | 57-24797 | 5/1982 |
| JP | 57-24798 | 5/1982 |
| JP | 57-73087 | 5/1982 |
| JP | 61-87690 | 5/1986 |
| JP | 61-106587 | 5/1986 |
| JP | 62-81396 | 4/1987 |
| JP | 62-156188 | 7/1987 |
| JP | 62-156198 | 7/1987 |
| JP | 1-108298 | 4/1989 |
| JP | 1-225696 | 9/1989 |
| JP | 3-7798 | 1/1991 |
| JP | 3-28296 | 2/1991 |

OTHER PUBLICATIONS

Perry, R. H. and Green, D., *Perry's Chemical Engineerrs' Handbook Sixth Edition*, pp. 12–28 (1984).

1896 Ashrae Handbook, *Refrig. Syst. and Applics. Inch-Pound Ed.,* pp. 8.8–8.16 (1986).

Japanese Language Publication "Refrigeration", vol. 63, No. 733, p. 1137 and certified translation into English (date Unknown).

Japanese Language Publication "High Pressure Gas Technology", N. Sakawa, editor, Kyouritsu Shuppan K.K., publ., (1966), pp. 82–83 and certified translation into English.

Derwent English language abstract of Japanese Laid–Open No. 1–108,298, Apr. 1989.

Derwent English language abstract of Japanese Laid–Open No. 1–225,696, Sep. 1989.

* cited by examiner

*Primary Examiner*—Alan Diamond
(74) *Attorney, Agent, or Firm*—Olson & Hierl, Ltd.

(57) ABSTRACT

A lubricant for use in a refrigerator which operates with a chlorine-free Flon (fluorocarbon)-type refrigerant whose molecules do not contain chlorine. The lubricant contains a synthetic oil, and molybdenumoxysulfide diorganophosphorodithioate given by the following formula (1) and/or molybdenumoxysulfide diorganodithiocarbamate given by the following formula (2), the content of the compounds of formulae (1) and (2) in total ranges from 0.1 to 10 wt % to the content of the synthetic oil:

$$\{(RO)_2PS_2\}_2Mo_2S_XO_Y \quad (1)$$

where R represents a hydrocarbon group having 3 to 20 carbon atoms, and X and Y are numbers which meet the conditions of $O \leqq X \leqq 4$, $0 \leqq Y \leqq 4$ and $X+Y=4$; and $$(R'_2NCS_2)_2Mo_2S_X'O_Y' \quad (2)$$

where R' is a hydrocarbon group having 3 to 20 carbon atoms and X' and Y' are numbers which meet the conditions of $)\leqq X' \leqq 4$, $0 \leqq Y' \leqq 4$ and $X'+Y'=4$.

16 Claims, No Drawings

LUBRICATED REFRIGERANT COMPOSITION CONTAINING FLUOROCARBON-TYPE REFRIGERANT, SYNTHETIC OIL AND MOLYBDENUMOXYSULFIDE DERIVATIVES

RELATED APPLICATION

This application is a continuation of our earlier filed U.S. patent application Ser. No. 07/924,860 filed Aug. 4, 1992 now abandoned.

BACKGROUND OF THE INVENTION

1. Field of the Invention

The present invention relates to a lubricant for refrigerators and, more particularly, to a lubricant suitable for use in refrigerators in combination with a fluorocarbon-type refrigerant the molecules of which do not contain chlorine, such as R 134 a (1,1,1,2-tetrafluoroethane).

2. Description of the Related Art

Fluorocarbon-type refrigerants are known to the prior art and have been used in refrigerators as this type of refrigerants is chemically stable and exhibits little toxicity. It has been recognized in recent years, however, that chlorofluorocarbons such as chlorofluorocarbon R 12 (dichlorodifluoromethane), has been a cause of damage to the earth's atmosphere such as breaking down the ozone layer in the stratosphere and of warming of the earth. For this reason, it has been agreed in the Montreal Protocol that the use of chlorofluorocarbon-type refrigerants is to be completely abolished after the year of 2000.

Under these circumstances, chlorine-free fluorocarbon-type refrigerants whose molecules do not contain chlorine, represented by fluorocarbon R 134a (1,1,1,2-tetrafluoroethane) have been proposed as substitutes for chlorofluorocarbon such as R-12. Compared with the chlorofluorocarbon R-12 which has been used conventionally, chlorine-free refrigerants such as fluorocarbon R-134a exhibit high polarity and poor compatibility (that is, poor mutual solubility or miscibility) with lubricants such as napthenic mineral oil or alkyl benzene which have been commonly used in refrigerators. In order to overcome this problem, various lubricants for refrigerators have been proposed such as polyalkylene glycol-type lubricants as disclosed in U.S. Pat. No. 4,755,316 and Japanese Patent Laid-Open No. 3-28296 and ester-type lubricants as disclosed in Japanese Patent Laid-Open No. 2-268068.

In chlorofluorocarbon-type refrigerants such as chlorofluorocarbon R-12, chlorine contained in the molecules contributes to the maintenance of extreme pressure performance in the refrigerant compressor. Unfortunately, however, the fluorocarbon R-134a and other chlorine-free fluorocarbon-type refrigerants cannot provide sufficient extreme-pressure performance because they lack chlorine, even when used in combination with the above-mentioned newly-developed refrigerator lubricants. Consequently, loss of energy and wear due to friction are increased in the sliding portions of the compressor such as bearings, pistons and seals, resulting in seizures in the worst case.

Known extreme-pressure additives used for refrigerator lubricants can be broadly sorted into two types; namely, sulfur-type additives and phosphor-type lubricants. A sulfur-type extreme-pressure additive is disclosed in Japanese Patent Laid-Open No. 57-8294. This additive forms a sulfide film on the sliding surface which imparts superior extreme-pressure performance so as to reduce friction in a refrigerator, but it is undesirably corrosive in nature and has impaired wear resistance.

Examples of phosphor-type extreme-pressure additives are alkyl-substituted phosphates disclosed in Japanese Patent Laid-Open No. 62-156198 and a combination of phosphite and tricresyl phosphate disclosed in Japanese Patent Laid-Open No. 62-156188. A compound which does not have a benzene ring or an alkylene group, e.g., trioleyl phosphate, exhibits only limited solubility to fluorocarbon-type refrigerant which do not contain chlorine in their molecules, e.g., fluorocarbon R-134a. The known phosphor-type extreme-pressure additives, therefore, not only fail to appreciably improve extreme pressure performance, but they also have the opposite effect of increasing wear of the sliding parts in the refrigerators. Tricresyl phosphate exhibits solubility to fluorocarbon-type refrigerants whose molecules do not contain chlorine, e.g., fluorocarbon R-134a. This additive, however, does not produce any remarkable effect on the improvement in the lubricating performance.

Under these circumstances, the inventors have developed and proposed, in Japanese Patent Laid-Open No. 2-216764, an alkylene-group containing phosphite and phosphate as an extreme-pressure additive for use in refrigerators which operate with chlorine-free fluorocarbon-type refrigerants such as fluorocarbon R-134a. This extreme-pressure additive is still unsatisfactory in that it does not provide sufficiently high extreme-pressure performance and in that it cannot be practically used.

SUMMARY OF THE INVENTION

Accordingly, an object of the present invention is to provide a lubricant for use in refrigerators which exhibits superior solubility to chlorine-free fluorocarbon-type refrigerant whose molecules do not contain any chlorine such as fluorocarbon R-134a, as well as superior anti-seizure and anti-wear characteristics.

Through an intense study on lubricants for use with chlorine-free fluorocarbon-type refrigerants in refrigerators, the inventors have discovered that the above-described object of the invention can be achieved by a lubricant having the following features.

Namely, according to the present invention, there is provided a lubricant for use in a refrigerator which operates in combination with (that is, is mutually soluble with, or in miscible with) a chlorine-free fluorocarbon-type refrigerant whose molecules do not contain chlorine, the lubricant containing a synthetic oil, and 0.1 to 10 wt % total based on the weight of the synthetic oil of a least one molybdenumoxysulfide compound. The molybdenumoxysulfide compound is selected from the group consisting of molybdenumoxysulfide diorganophosphorodithioate given by the following formula (1), molybdenumoxysulfide diorganophosphorodithioates given by the following formula (2), and mixtures thereof. Thus, compounds of formula (1) have the formula:

$$\{(RO)_2PS_2\}_2Mo_2S_XO_Y \quad (1)$$

where R represents a hydrocarbon group having 3 to 20 carbon atoms inclusive, and X and Y are each a number which meets the conditions of $0 \leqq X \leqq 4$, $0 \leqq Y \leqq 4$ and $X+Y=4$ and compounds of formula (2) have the formula:

$$(R'_2NCS_2)_2Mo_2S_{X'}O_{Y'} \quad (2)$$

where R' is a hydrocarbon group having 3 to 20 carbon atoms inclusive and X' and Y' are each a numbers which meets the conditions of $0 \leqq X' \leqq 4$, $0 \leqq Y' \leqq 4$ and $X'+Y'=4$.

General Description of the Invention

In a compound the the formula (1) used in the present invention, R may be any hydrocarbon group having 3 to 20 carbon atoms inclusive. Preferably, however, R is a primary alkyl group having 3 to 20 carbon atoms inclusive (more preferably primary alkyl group having 3 to 14 carbon atoms), a secondary alkyl group having 3 to 20 carbon atoms inclusive (more preferably secondary alkyl group having 3 to 14 carbon atoms) or an allyl group having 6 to 20 carbon atoms. Examples of such groups are: an isopropyl group, butyl group, isobutyl group, amyl group, 4-methyl-2-pentyl group, 2-ethylhexyl group, tridecyl group, lauryl group, oleyl group, linoleyl group, p-tertiary butyl phenyl group, nonylphenyl group and so forth. Each of these groups can be used alone or two or more of these groups may be used simultaneously in a single compound of formula (1). Among these groups, most preferably used are an isobutyl group, a 4-methyl-2-pentyl group, a 2-ethylhexyl group, and a tridecyl group.

When the number of carbon atoms of R exceed the above-specified range, the compatibility (that is, the vapor phase solubility or the liquid phase solubility or miscibility) of the lubricant with a refrigerant such as fluorocarbon R-134a is impaired. Conversely, when the number of the carbon atoms is below the above-specified range, the compatibility of a compound of formula (1) with the lubricating oil is impaired.

In a compound given by formula (1), X and Y are required to meet the conditions of $0 \leqq X \leqq 4$, $0 \leqq Y \leqq 4$ and $X+Y=4$.

A compound given by formula (1) can be prepared by one of the processes which is disclosed in Japanese Patent Publication No. 57-24798, Japanese Patent Publication No. 57-24799, Japanese Patent Laid-Open No. 61-87690 and Japanese Patent Laid-Open No. 61-106587.

In a compound of formula (2) used in the present invention, R' may be any hydrocarbon group having 3 to 20 carbon atoms inclusive. Preferably, however, R is a primary alkyl group having 3 to 20 carbon atoms inclusive (more preferably primary alkyl group having 3 to 14 carbon atoms inclusive), a secondary alkyl group having 3 to 20 carbon atoms inclusive (more preferably secondary alkyl group having 3 to 14 carbon atoms inclusive) or an allyl group having 6 to 20 carbon atoms inclusive. Examples of such groups are: an isopropyl group, butyl group, isobutyl group, amyl group, 4-methyl-2-pentyl group, 2-ethylhexyl group, tridecyl group, lauryl group, oleyl group, linoleyl group, nonylphenyl group, p-tertiary butyl phenyl group and so forth. Each of these groups can be used alone or two or more of these groups may be used simultaneously in a single compound of formula (2). Among these groups, most preferably used are an isobutyl group, a 4-methyl-2-pentyl group, a 2-ethylhexyl group, and a tridecyl group.

When the number of the carbon atoms of R' exceed the above-specified range, the compatibility of the lubricant with a refrigerant such as fluorocarbon R-134a is impaired. Conversely, when the number of the carbon atoms is below the above-specified range, the compatibility of a compound of formula (2) with the lubricating oil is impaired.

In a compound given by formula (2), X' and Y' are required to meet the conditions of $0 \leqq X' \leqq 4$, $0 \leqq Y' \leqq 4$ and $X+Y=4$.

A compound given by formula (2) can be prepared by one of the processes disclosed in Japanese Patent Publication No. 53-31646, Japanese Patent Publication No. 55-40593, Japanese Patent Publication No. 56-12638, Japanese Patent Publication No. 57-24797, Japanese Patent Publication No. 58-50233 and Japanese Patent Laid-Open No. 62-81396.

There is no specific restriction in the synthetic oil used in the present invention, and any synthetic oil is usable provided that it exhibits preferably superior compatibility with the chlorine-free fluorocarbon-type refrigerant such as fluorocarbon 134a which does not contain chlorine in its molecules. Preferably, the synthetic oil is materially compatible with (that is soluble with) the chlorine-free fluorocarbon-type refrigerant such as fluorocarbon R-134a when the refrigerant is in a liquid state at a temperature of −30° C. to 50° C. and exhibits a kinematic viscosity of 2 to 50 cst at 100° C. Preferably, the synthetic oil is chorine-free. Examples of a synthetic oil that may be suitably used include polyoxyalkylene glycol, modifications of polyoxyalkylene glycol, neopentylpolyol ester, dibasic acid ester, and fluorinated oil. Such an oil maybe used alone or two or more of such oils can be used simultaneously in the form of a mixture.

Practical examples of polyoxyalkylene glycol are: polyoxypropylene glycol, polyoxyethylene glycol and polyoxyethylene polyoxypropylene glycol, preferably having a molecular weight of 200 to 3000. The oxyethylene group and the oxypropylene group in the polyoxyethylene polyoxypropylene glycol may be random groups or block groups.

Examples of modifications of polyoxyalkylene glycol include: polyoxyalkylene glycol monoalkylether, polyoxyalkylene glycol dialkylether, polyoxyalkylene glycol monoester, polyoxyalkylene glycol diester, and alkylene oxide adduct of alkylene diamine. More practically, it is possible to use an ether of polyoxyalkylene glycol and a straight-chain or branched-chain alkyl group having 1 to 18 carbon atoms inclusive; an ester of polyoxyalkylene glycol and an aliphatic carboxylic acid having 2 to 18 carbon atoms inclusive; and a propyleneoxide adduct, an ethyleneoxide adduct, an ethyleneoxide propyleneoxide random adduct or ethyleneoxide propyleneoxide block adduct of ethylene diamine, diethylene triamine and triethylene tetramine. It is also possible to use, as the modification of oxyalkylene glycol, polyoxyalkylene glycol glycerol triether and a halide of, particularly chlorinated, polyoxyalkylene glycol.

The neopentyl polyol ester is preferably an ester of neopentyl polyol and an aliphatic carboxylic acid having 2 to 16 carbon atoms inclusive, preferably 2 to 9 carbon atoms inclusive, and more preferably an ester with trimethylol propane, pentaerythritol, dipentaerythritol and tripentaerythritol.

Examples of the dibasic ester suitably used is an ester of a bivalent carboxylic acid and a primary or secondary alcohol having 4 to 18 carbon atoms inclusive. Practical examples of such an ester are dibutylphthalate and dihexyladipate.

A perfluoroether as disclosed in Japanese Patent Laid-Open No. 3-7798 can be used as the fluorinated oil.

In the lubricant of the present invention for use in a refrigerator, molybdenumoxysulfide diorganophosphorodithioate given by formula (1) and/or molybdenumoxysulfide diorganodithiocarbamate given by formula (2) is contained in an amount which is 0.1 to 10 wt %, preferably 0.5 to 5 wt %, in total of the synthetic oil.

When both the molybdenumoxysulfide diorganophosphorodithioate given by formula (1) and molybdenumoxysulfide diorganodithiocarbamate given by formula (2) are simultaneously used, the mixing ratio between these compounds may be selected freely provided that the total content of these compounds fall within the range mentioned above.

When the content of molybdenumoxysulfide diorganophosphorodithioate of formula (1) and/or molybdenumoxysulfide diorganodithiocarbamate of formula (2) is below the range specified above, it is not possible to obtain satisfactory performance of the lubricant, whereas, when the upper limit of the above-specified range is exceeded, corrosion is undesirably promoted while the reduction in the friction loss is not so remarkable.

The lubricants for refrigerators of the present invention may, when desired and within the scope of the object of the invention, contain other extreme-pressure additives such as tricresyl phosphate, as well as an additive or additives ordinarily used in lubricants used for refrigerators employing flourocarbon-type refrigerants, such as a stabilizing additive, e.g., neopentyl glycol diglycidylether, polypropyleneglycol diglycidylether and phenyl glycidylether, and an anti-oxidation agent, e.g., δ-naphthylbenzylamine, phenothiadine and BHT. The content of such additive, when used, should be within a range which is ordinarily adopted in refrigerator lubricants.

The lubricants for refrigerator usage that are provided by the invention exhibit superior compatibility with chlorine-free fluorocarbon refrigerants having no chlorine in their molecules, such as fluorocarbon R-134a, as well as excellent extreme-pressure performance and anti-wear characteristics, thus offering distinguished lubricating performance when used together with such chlorine-free refrigerants in various refrigerators which operate with such type of refrigerants.

The weight ratio of fluorocarbon-type refrigerant to synthetic oil in a refrigerant composition of this invention can range widely; for example, from about 1:99 to about 99:1.

EXAMPLES

Examples of lubricants in accordance with the present invention are shown below. It is to be understood, however, such Examples are only illustrative and are not intended to restrict the scope of the present invention.

Examples 1 to 19 and Comparative Examples 1 to 10

Various refrigerator lubricant compositions were prepared by using the following additives of Sample Nos. 1 to 8 and the following base oils of Samples 9 to 14 mixed at various ratios as shown in Table 1.

Sample No. 1

Molybdenumoxysulfide diorganophosphorodithioate given by the following formula:

$$\{(RO)_2PS_2\}_2Mo_2S_XO_Y$$

where R represents a 2-ethylhexyl group, X is 2 and Y is 2.

Sample No. 2

Molybdenumoxysulfide diorganophosphorodithioate given by the following formula:

$$\{(RO)_2PS_2\}_2Mo_2S_XO_Y$$

where R represents a 4-methyl-2-pentyl group, X is 2 and Y is 2.

Sample No. 3

Molybdenumoxysulfide diorganodithiocarbamate given by the following formula:

$$(R_2NCS_2)_2Mo_2S_X'O_Y'$$

where R is a tridecyl group and 2-ethylhexyl group of equal mol amounts, X' is 2 and Y' is 2.

Sample No. 4

Molybdenumoxysulfide diorganodithiocarbamate given by the following formula:

$$(R_2NCS_2)_2Mo_2S_X'O_Y'$$

where R is an isobutyl group and a 2-ethylhexyl group of equal mol amounts, X' is 2 and Y' is 2.

Sample No. 5

Molybdenumoxysulfide diorganodithiocarbamate given by the following formula:

$$(R_2NCS_2)_2Mo_2S_X'O_Y'$$

where R is a methyl group and a 2-ethylhexyl group of equal mol amounts, X' is 2 and Y' is 2.

Sample No. 6

Tricresyl phosphate

Sample No. 7

Trioleyl phosphate

Sample No. 8

A compound expressed by the following formula:

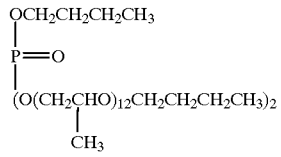

Sample No. 9

Polyoxyalkylene glycol alkylether expressed by the following formula:

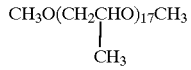

(kinematic viscosity 33.1 cst at 40° C.).

Sample No. 10

Full ester of pentaerythritol and a mixture (mol ratio 1:1) of 2-methylbutanoate and hexanoic acid. (kinematic viscosity 20 cst at 40° C.).

Sample No. 11

Full ester of dipentaerythritol and a mixture (mol ratio 1:1) of hexanoic acid and ethyl butanoate (kinematic viscosity 82.7 cst at 40° C.).

Sample No. 12

Full ester of tripentaerythritol and mixture (mol ratio 2:1:7) of pentanoic acid, 2-methylbutanoate and 2-ethylbutanoate (kinematic viscosity 202 cst at 40° C.).

Sample No. 13

Polyoxyalkylene glycol diacetate expressed by the following formula:

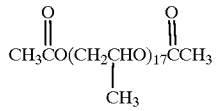

(kinematic viscosity 51.5 cst at 40° C.).

Sample No. 14

Polyoxyalkylene glycol alkylether expressed by the following formula:

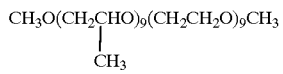

where $(CH_2CHO)$ and $(CH_2CH_2O)$ are randomly polymerized (kinematic viscosity 38.7 cst at 40° C.).

The refrigerator lubricant compositions thus prepared were subjected to tests which were conducted as follows for the purpose of examining solubility to fluorocarbon and anti-seizure performance. Comparative Example 3 was not tested because the additive failed to be mixed with the base oil allowing sedimentation.

Fluorocarbon solubility test

A mixture of 15 wt parts of each of the lubricant compositions of Table 1 and 85 wt parts of fluorocarbon R-134a was charged in a 1-litre glass autoclave for the purpose of examination of compatibility in a temperature range of −50 to +60° C.

Anti-seizure test

A test was conducted on each refrigerator lubricant composition in accordance with ASTM-D3233 using a Falex tester. The anti-seizure test was conducted at an initial oil temperature of 25° C. and after a 5-minute running-in operation at 250 lb.

As will be understood from the foregoing description, the present invention provides a refrigerator lubricant which exhibits superior solubility even in a chlorine-free fluorocarbon-type refrigerant which does not contain chlorine in its molecules, e.g., fluorocarbon R-134a, as well as excellent anti-seizure and anti-wear characteristics and friction-reducing effects.

Thus, the lubricant of the present invention that is adapted for use in a refrigerator offers the following advantages: (1) Eliminates troubles in the evaporator of the refrigeration cycle because it exhibits superior solubility even in a chlorine-free fluorocarbon-type refrigerant which does not contain chlorine in its molecules, e.g., fluorocarbon R-134a. (2) Prevents seizure and abnormal vibration which tend to occur under inferior lubricating conditions, e.g., during start up of the refrigerator, by virtue of its high extreme-pressure performance. (3) Exhibits excellent anti-wear characteristic so as to extend the life of a refrigerator compressor while suppressing undesirable effects due to wear by dust particles. (4) Excels in friction-reducing performance so as to enable the refrigerator to operate at optimum performance.

TABLE 1

| Examples and Comparative Examples | Base oil | Additives | Additive to base oil ratio (wt %) |
|---|---|---|---|
| Example 1 | Sample No. 9 | Sample No. 1 | 3 |
| Example 2 | Sample No. 9 | Sample No. 2 | 3 |
| Example 3 | Sample No. 9 | Sample No. 3 | 3 |
| Example 4 | Sample No. 9 | Sample No. 4 | 3 |
| Example 5 | Sample No. 10 | Sample No. 2 | 1 |
| Example 6 | Sample No. 10 | Sample No. 2 | 3 |
| Example 7 | Sample No. 10 | Sample No. 2 | 5 |
| Example 8 | Sample No. 10 | Sample No. 4 | 1 |
| Example 9 | Sample No. 10 | Sample No. 4 | 3 |
| Example 10 | Sample No. 10 | Sample No. 4 | 5 |
| Example 11 | Sample No. 10 | Sample Nos. 1, 3 | 1, 1 |
| Example 12 | Sample No. 10 | Sample Nos. 1, 3 | 1, 4 |
| Example 13 | Sample No. 10 | Sample Nos. 1, 3 | 4, 1 |
| Example 14 | Sample No. 9 | Sample No. 1 | 0.3 |
| Example 15 | Sample No. 9 | Sample No. 1 | 7.5 |
| Example 16 | Sample No. 11 | Sample No. 2 | 3 |
| Example 17 | Sample No. 12 | Sample No. 2 | 3 |
| Example 18 | Sample No. 13 | Sample No. 2 | 3 |
| Example 19 | Sample No. 14 | Sample No. 2 | 3 |
| Comp. Example 1 | Sample No. 9 | | 3 |
| Comp. Example 2 | Sample No. 10 | | 3 |
| Comp. Example 3 | Sample No. 9 | Sample No. 5 | 3 |
| Comp. Example 4 | Sample No. 9 | Sample No. 6 | 3 |
| Comp. Example 5 | Sample No. 9 | Sample No. 7 | 3 |
| Comp. Example 6 | Sample No. 9 | Sample No. 8 | |
| Comp. Example 7 | Sample No. 11 | | |

TABLE 1-continued

| Examples and Comparative Examples | Base oil | Additives | Additive to base oil ratio (wt %) |
|---|---|---|---|
| Comp. Example 8 | Sample No. 12 | | |
| Comp. Example 9 | Sample No. 13 | | |
| Comp. Example 10 | Sample No. 14 | | |

TABLE 2

| Examples and Comparative Examples | Fluorocarbon Compatibility | Anti-seizure test Seizure load (lb) |
|---|---|---|
| Example 1 | Fully dissolved | 2,400 |
| Example 2 | Fully dissolved | 2,450 |
| Example 3 | Fully dissolved | 2,300 |
| Example 4 | Fully dissolved | 2,350 |
| Example 5 | Fully dissolved | 2,100 |
| Example 6 | Fully dissolved | 2.300 |
| Example 7 | Fully dissolved | 2.350 |
| Example 8 | Fully dissolved | 2,100 |
| Example 9 | Fully dissolved | 2.200 |
| Example 10 | Fully dissolved | 2,350 |
| Example 11 | Fully dissolved | 2,200 |
| Example 12 | Fully dissolved | 2,350 |
| Example 13 | Fully dissolved | 2.400 |
| Example 14 | Fully dissolved | 2,100 |
| Example 15 | Fully dissolved | 2.450 |
| Example 16 | Fully dissolved | 2.300 |
| Example 17 | Fully dissolved | 2,300 |
| Example 18 | Fully dissolved | 2.450 |
| Example 19 | Fully dissolved | 2.350 |
| Comp. Example 1 | Fully dissolved | 650 |
| Comp. Example 2 | Fully dissolved | 850 |
| Comp. Example 3 | Insoluble to oil | |
| Comp. Example 4 | Fully dissolved | 950 |
| Comp. Example 5 | Cloudy | |
| Comp. Example 6 | Fully dissolved | 1250 |
| Comp. Example 7 | Fully dissolved | 900 |
| Comp. Example 8 | Fully dissolved | 850 |
| Comp. Example 9 | Fully dissolved | 850 |
| Comp. Example 10 | Fully dissolved | 750 |

What is claimed is:

1. A composition for use in a refrigerator as a lubricating refrigerant which has extreme high-pressure lubricating capacity, said composition comprising in admixture a chlorine-free fluorocarbon refrigerant whose molecules do not contain chlorine, a synthetic oil which does not contain chlorine and which has a kinematic viscosity of 2 to 50 cst at 100° C., and 0.1 to 10 wt % based on the total weight of said synthetic oil of at least one molybdenumoxysulfide compound selected from the group consisting of molybdenumoxysulfide diorganophosphorodithioate given by the following formula (1):

$$\{(RO)_2PS_2\}_2Mo_2S_XO_Y \quad (1)$$

in which R represents a hydrocarbon group having 3 through 20 carbon atoms, and X and Y are each a number which meet the conditions of $0 \leqq X \leqq 4$, $0 \leqq Y \leqq 4$ and $X+Y=4$, molybdenumoxysulfide diorganodithiocarbamate given by the following formula (2)

$$(R'_2NCS_2)_2Mo_2S_{X'}O_{Y'} \quad (2)$$

in which R' is a hydrocarbon group having 3 through 20 carbon atoms and X' and Y' are each a number which meet the conditions of $0 \leqq X' \leqq 4$, $0 \leqq Y' \leqq 4$ and $X'=4$, and mixtures thereof, said molybdenumoxysulfide compound being soluble in said synthetic oil, and said synthetic oil being soluble with said refrigerant when said refrigerant is in a liquid state at a temperature ranging from −30 to 50° C.

2. The composition of claim 1 wherein each R in said formula (1) is independently selected from the group consisting of primary alkyl having 3 through 20 carbon atoms, secondary alkyl having 3 through 20 carbon atoms and allyl having 6 through 20 carbon atoms.

3. The composition of claim 1 wherein each R in said formula (1) is independently selected from the group consisting of isopropyl, butyl, isobutyl, amyl, 4-methyl-2-pentyl, 2-ethylhexyl, tridecyl, lauryl, oleyl, linoleyl, p-tertiary butyl pheny and nonylphenyl.

4. The composition of claim 3 wherein each R in said formula (1) is independently selected from the group consisting of isobutyl, 4-methyl-2-pentyl, 2-ethylhexyl and tridecyl.

5. The composition of claim 1 wherein each R' in said formula (2) is independently selected from the group consisting of primary alkyl group having 3 through 20 carbon atoms, secondary alkyl having 3 through 20 carbon atoms and allyl having 6 through 20 carbon atoms.

6. The composition of claim 5 wherein each R' in said formula (2) is independently selected from the group consisting of isopropyl, butyl, isobutyl, amyl, 4-methyl-2-pentyl, 2-ethylhexyl, tridecyl, lauryl, oleyl, linoleyl, p-tertiary butyl phenyl and nonylphenyl.

7. The composition of claim 6 wherein each R' in said formula (2) is independently selected from the group consisting of isobutyl, 4-methyl-2-pentyl, 2-ethylhexyl and tridecyl.

8. The composition of claim 1 wherein the total content of said molybdenumoxysulfide compounds ranges from 0.5 to 5 wt % based on the total weight of said synthetic oil.

9. A composition for use in a refrigerator as a lubricating refrigerant which has extreme high-pressure lubricating capacity, said composition comprising in admixture a chlorine-free fluorinated hydrocarbon refrigerant whose molecules do not contain chlorine, a synthetic oil which does not contain chlorine in its molecules and which has a kinematic viscosity of 2 to 50 cst at 100° C., and 0.1 to 10 wt % based on the total weight of said synthetic oil of at least one molybdenumoxysulfide diorganophosphorodithioate having the following formula:

$$\{(RO)_2PS_2\}_2Mo_2S_XO$$

in which R represents a hydrocarbon group having 3 through 20 carbon atoms, and X and Y are each a number which meets the conditions of $0 \leqq X \leqq 4$, $0 \leqq Y \leqq 4$ and $X+Y=4$, said compound being soluble in said synthetic oil, and said synthetic oil being miscible with said refrigerant when said refrigerant is in a liquid state at a temperature ranging from −30 to 50° C.

10. The composition of claim 9 wherein each R in said formula is independently selected from the group consisting of primary alkyl groups having 3 through 20 carbon atoms each, secondary alkyl group having 3 through 20 carbon atoms each and allyl group having 6 to 20 carbon atoms each.

11. The composition of claim 9 wherein each R in said formula is independently selected from the radical group consisting of isopropyl, butyl, isobutyl, amyl, 4-methyl-2-pentyl, 2-ethylhexyl, tridecyl, lauryl, oleyl, linoleyl, p-tertiary butyl phenyl and nonylphenyl.

12. The composition of claim 11 wherein each R in said formula is independently selected from the radical group consisting of isobutyl, 4-methyl-2-pentyl, 2-ethylhexyl and tridecyl.

13. A composition for use in a refrigerator as a lubricating refrigerant which has extreme high-pressure lubricating capacity, said composition comprising in admixture a chlorine-free fluorinated hydrocarbon refrigerant whose molecules do not contain chlorine, a synthetic oil which does not contain chlorine in its molecules and which has a kinematic viscosity of 2 to 50 cst at 100° C., and 0.1 to 10 wt % based on the total weight of said synthetic oil of at least one molybdenumoxysulfide diorganodithiocarbamate having the following formula:

$$(R'_2NCS_2)_2Mo_2S_{X'}O_{Y'}$$

in which R' is a hydrocarbon group having 3 through 20 carbon atoms and X' and Y' are each a number which meets the conditions of $0 \leqq X' \leqq 4$, $0 \leqq Y' \leqq 4$ and $X'+Y'$, said compound being soluble in said synthetic oil, and said synthetic oil being miscible with said refrigerant when said refrigerant is in a liquid state at a temperature ranging from −30 to 50° C.

14. The composition of claim 13 wherein each R' in said formula is independently selected from the group consisting of primary alkyl group having 3 through 20 carbon atoms each, secondary alkyl group having 3 to 20 carbon atoms each and allyl group having 6 to 20 carbon atoms each.

15. The composition of claim 13 wherein each R' in said formula is independently selected from the radical group consisting of isopropyl, butyl, isobutyl, amyl, 4-methyl-2-pentyl, 2-ethylhexyl, tridecyl, lauryl, oleyl, linoleyl, p-tertiary butyl phenyl and nonylphenyl.

16. The composition of claim 15, wherein each R' in said formula is independently selected from the radical group consisting of isobutyl, 4-methyl-2-pentyl, 2-ethylhexyl and tridecyl.

* * * * *

UNITED STATES PATENT AND TRADEMARK OFFICE

CERTIFICATE OF CORRECTION

PATENT NO. : 6,379,581 B1 
DATED : April 30, 2002
INVENTOR(S) : Tamiji Kamakura et al.

It is certified that error appears in the above-identified patent and that said Letters Patent is hereby corrected as shown below:

Title page,
Item [57], last line of Abstract, delete ")≦X' ≦4, 0≦Y' ≦4 and X' +Y' =4" and insert -- 0≦X' ≦4, 0≦Y' ≦4 and X' +Y' =4 --.

Column 1,
Line 25, delete "R 12" and insert -- R-12 --.
Line 35, delete "R134a" and insert -- R-134a --.

Column 2,
Line 66, delete "numbers" and insert -- number --.

Column 3,
Line 1, delete "the" first occurrence.

Column 5,
Line 21, insert -- - -- after "flurocarbon".

Column 8,
Line 63, delete "0≦X' ≦4, 0≦Y' ≦4 and X' =4" and insert -- 0≦X' ≦4, 0≦Y' ≦4 and X' +Y' =4 --.

Column 9,
Line 10, delete "pheny" and insert -- phenyl --.
Line 42, delete "$\{(RO)_2PS_2\}_2Mo_2S_xO$" and insert -- $\{(RO)_2PS_2\}_2Mo_2S_xO_y$ --.

UNITED STATES PATENT AND TRADEMARK OFFICE

CERTIFICATE OF CORRECTION

PATENT NO. : 6,379,581 B1 
DATED : April 30, 2002
INVENTOR(S) : Tamiji Kamakura et al.

It is certified that error appears in the above-identified patent and that said Letters Patent is hereby corrected as shown below:

Column 10,
Line 31, delete "$0 \leqq X' \leqq 4$, $0 \leqq Y' \leqq 4$ and $X' = 4$" and insert $X' + Y'$ ," and insert -- $0 \leqq X' \leqq 4$, $0 \leqq Y' \leqq 4$ and $X' + Y' = 4$ --.

Signed and Sealed this

Fifteenth Day of April, 2003

JAMES E. ROGAN
*Director of the United States Patent and Trademark Office*